US010803836B2

(12) United States Patent
Liao

(10) Patent No.: US 10,803,836 B2
(45) Date of Patent: Oct. 13, 2020

(54) SWITCH DEVICE AND SWITCH SYSTEM AND THE METHODS THEREOF

(71) Applicant: ATEN International Co., Ltd., New Taipei (TW)

(72) Inventor: Chun-Chi Liao, New Taipei (TW)

(73) Assignee: ATEN International Co., Ltd., New Taipei (TW)

( * ) Notice: Subject to any disclaimer, the term of this patent is extended or adjusted under 35 U.S.C. 154(b) by 0 days.

(21) Appl. No.: 16/585,821

(22) Filed: Sep. 27, 2019

(65) Prior Publication Data

US 2020/0105229 A1 Apr. 2, 2020

(30) Foreign Application Priority Data

Sep. 28, 2018 (TW) ..... 107134512 A
Sep. 26, 2019 (TW) ..... 108134740 A

(51) Int. Cl.
*G09G 5/377* (2006.01)
*G09G 5/38* (2006.01)

(52) U.S. Cl.
CPC ..... *G09G 5/377* (2013.01); *G09G 5/38* (2013.01); *G09G 2340/0464* (2013.01); *G09G 2340/125* (2013.01); *G09G 2354/00* (2013.01)

(58) Field of Classification Search
CPC ..... G06F 3/0481; G09G 2340/0464; G09G 2340/12; G09G 2340/125; G09G 2354/00; G09G 2370/20; G09G 5/08; G09G 5/14; G09G 5/377; G09G 5/38
See application file for complete search history.

(56) References Cited

U.S. PATENT DOCUMENTS

2011/0047306 A1 2/2011 Dickens et al.
2014/0282050 A1 9/2014 Quinn et al.
2015/0147046 A1* 5/2015 Van Broeck ..... H04N 13/178 386/278
2020/0105229 A1* 4/2020 Liao ..... G06F 3/0481

FOREIGN PATENT DOCUMENTS

CN 102117187 A 7/2011

* cited by examiner

*Primary Examiner* — Todd Buttram
(74) *Attorney, Agent, or Firm* — Chen Yoshimura LLP

(57) ABSTRACT

A switch device includes a first connection interface, a second connection interface, an video output interface, a control module and a processing module. The first connection interface receives a first video and the second connection interface receives a second video. The video output interface outputs an integrated video. The control module receives a control signals including a position data. The processing module generates the integrated video based on the first video and the second video. The integrated video includes a first sub-image having a first depth and a second sub-image having a second depth respectively corresponding to the first video and the second video. When the position data falls within an overlapping area of the first sub-image and the second sub-image, the processing module outputs the control signal to one of the first connection interface and the second connection interface based on the first depth and the second depth.

21 Claims, 13 Drawing Sheets

SWITCH DEVICE AND SWITCH SYSTEM AND THE METHODS THEREOF

BACKGROUND OF THE INVENTION

Field of the Invention

This invention relates to a multi-view switching system, device and related method, and in particular, it relates to multi-view switching system, device and related method used to control multiple host computers.

Description of Related Art

A multi-computer switch enables a user to use one set of keyboard, monitor and mouse to control multiple host computers. Typically, the display of multiple images originating from multiple controlled host computers is limited to certain particular display schemes. For example, one display scheme is to evenly divide the display screen to display multiple channels of image. When the user desires to change the display scheme, additional hardware (such as a press button) is required. Moreover, changing the display scheme may cause errors in the displayed position of the mouse cursor. Therefore, current multi-computer switches needs improvements.

When multiple images originating from the multiple controlled host computers overlap with each other on the screen, the user cannot accurately use the mouse to control the multiple host computers. The multi-computer switching device and method needs improvement for switching overlapping display images.

SUMMARY

Accordingly, the present invention is directed to a multi-view switching device and method, as well as a switching system and related method for a multi-view system, that can improve the user-friendliness of the operation and the accuracy of operation of the mouse or other pointing device.

In one aspect, the present invention provides a switching device, which includes a first connection interface, a second connection interface, a video output interface, a control module, and a processing module. The processing module is electrically coupled to the first connection interface, the second connection interface, the image output interface, and the control module. The first connection interface receives a first video. The second connection interface receives a second video. The video output interface outputs an integrated video. The control module receives a control signal, which includes a position data. The processing module generates the integrated video based on the first video and the second video. The integrated video includes a first sub-image corresponding to the first video and a second sub-image corresponding to the second video. The first sub-image has a first depth. The second sub-image has a second depth. When a part of the first sub-image and a part of the second sub-image overlap each other in an overlapping area, and the position data falls within the overlapping area, the processing module selects one of the first connection interface and the second connection interface based on the first depth and the second depth and outputs the control signal via the selected first or second connection interface.

In another aspect, the present invention provides a control method for a switching device, which includes the following steps: receiving a first video via a first connection interface; receiving a second video via a second connection interface; receiving a control signal, the control signal including a position data; and generating an integrated video based on the first video and the second video, wherein the integrated video includes a first sub-image corresponding to the first video and a second sub-image corresponding to the second video, the first sub-image having a first depth, the second sub-image having a second depth; outputting the integrated video; and when the position data falls within an overlapping area where a part of the first sub-image and a part of the second sub-image overlap each other, selecting one of the first connection interface and the second connection interface based on the first depth and the second depth, and outputting the control signal via the selected first or second connection interface.

In another aspect, the present invention provides a switching system which includes a switching device, a first host computer, a second host computer, a pointing device and a display device. The first host computer, second host computer, pointing device and display device are coupled to the switching device. The first host computer provides a first video to the switching device. The second host computer provides a second video to the switching device. The switching device generates an integrated video based on the first video and the second video. The pointing device provides a control signal to the switching device, the control signal including a position data. The display device receives the integrated video from the switching device and displays it. The integrated video includes a first sub-image corresponding to the first video and a second sub-image corresponding to the second video. The first sub-image has a first depth. The second sub-image has a second depth. When a part of the first sub-image and a part of the second sub-image overlap each other in an overlapping area, and the position data falls within the overlapping area, the switching device selects one of the first host computer and the second host computer based on the first depth and the second depth, and outputs the control signal received from the pointing device to the selected first or second host computer.

In another aspect, the present invention provides an operating method for a switching system, which includes the following steps: a switching device connecting to a first host computer and receiving a first video from the first host computer; the switching device connecting to a second host computer and receiving a second video from the second host computer; the switching device connecting to a pointing device and receiving a control signal from the pointing device, the control signal including a position data; the switching device generating an integrated video based on the first video and the second video, wherein the integrated video includes a first sub-image corresponding to the first video and a second sub-image corresponding to the second video, the first sub-image having a first depth, and the second sub-image having a second depth; the switching device outputting the integrated video to the display device; and when a part of the first sub-image and a part of the second sub-image overlap each other in an overlapping area, and the position data falls within the overlapping area, the switching device selecting one of the first host computer and the second host computer based on the first depth and the second depth, and outputting the control signal to the selected first or second host computer.

As described above, the switching device according embodiments of the present invention can assign different depths to images originating from different host computers, and generate an integrated video to be outputted to the display device. The pointing device can control different host computers, which improves the user-friendliness of the control of multiple host computers and improves the accuracy of the pointing device operation.

DETAILED DESCRIPTION OF PREFERRED EMBODIMENTS

Figure 1:
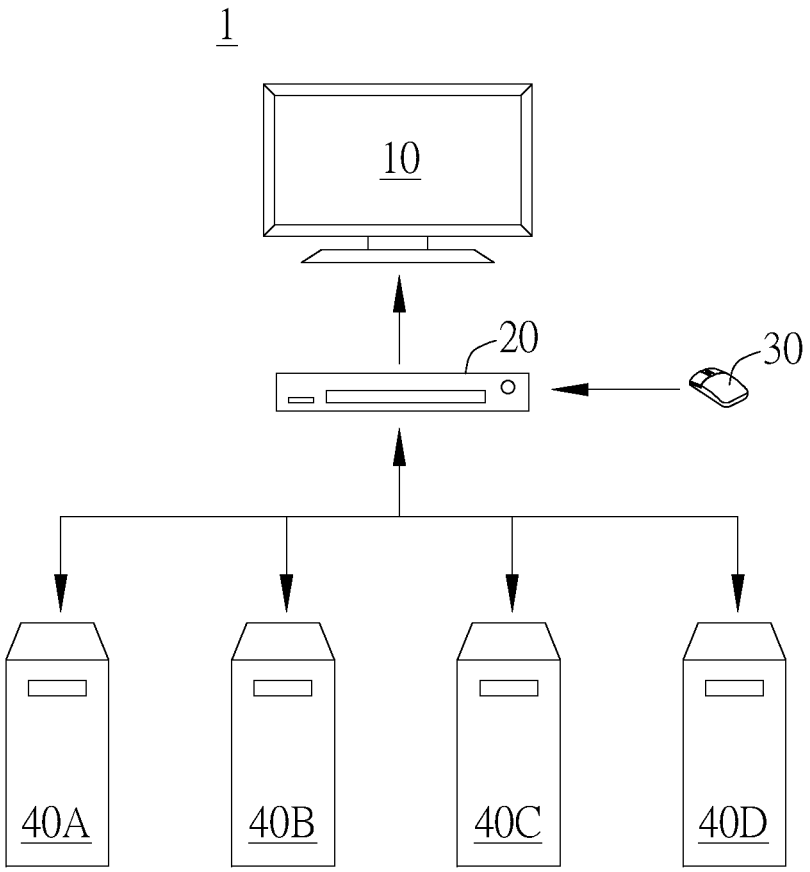
FIG. 1 schematically illustrates a multi-view system that displays multi-view images on the screen, according to an embodiment of the present invention.

FIG. 1 schematically illustrates a multi-view system (also referred to as a multi-computer system) 1 that displays multi-view images on the screen. As shown in FIG. 1, the multi-view display system 1 includes a display device 10, a multi-view controller 20, a pointing device 30, and multiple host computers 40A, 40B, 40C, 40D. The multi-view controller 20 is coupled to the display device 10. The pointing device 30 is coupled to the multi-view controller 20 to transmit position data to the latter. The multi-view controller 20 may include, without limitation, a multi-computer switch. The pointing device 30 may be, without limitation, a mouse, touch pad, track ball, etc. The multiple host computers 40A, 40B, 40C, 40D are respectively coupled to the multi-view controller 20. The multiple host computers 40A, 40B, 40C, 40D respectively outputs video data to the multi-view controller 20 to be displayed on the display device 10. In other words, the video image displayed on the display device 10 includes video images originating from different host computers. The number of host computers in the system is not limited; the descriptions below uses two host computers or four host computers as examples.

Based on the position data from the pointing device 30, the multi-view controller 20 determines an initial position in the output image that corresponds to the position data. The initial position refers to the absolute coordinate of the cursor (the icon representing the pointing device) in the entire displayed image. Based on the initial position and the different depths of the images of the different host computers, the multi-view controller 20 generates an absolute position, and transmits the absolute position to a host computer 40A, 40B, 40C, or 40D. The depths refer to the different layers of the different images of different host computers, so that overlapping areas of different images will obscure each other based on their depths. In other words, images having different depths appear to be located at different distances from the user along the line of sight of the user. The absolute position refers to the absolution coordinate of the cursor in an image of a host computer (e.g., host computer 40A). For example, based on the depths, the multi-view controller 20 determines the relationship between the initial position and the various images of the different host computers, to therefore obtain the coordinate of the cursor in a certain image (e.g., the image originating from host computer 40A). Thus, the absolute position obtained by transforming the absolute coordinate can improve the accuracy of the cursor position in the multi-view device, avoiding errors in determining the position of the pointing device 30, and improving operation efficiency.

Figure 2:
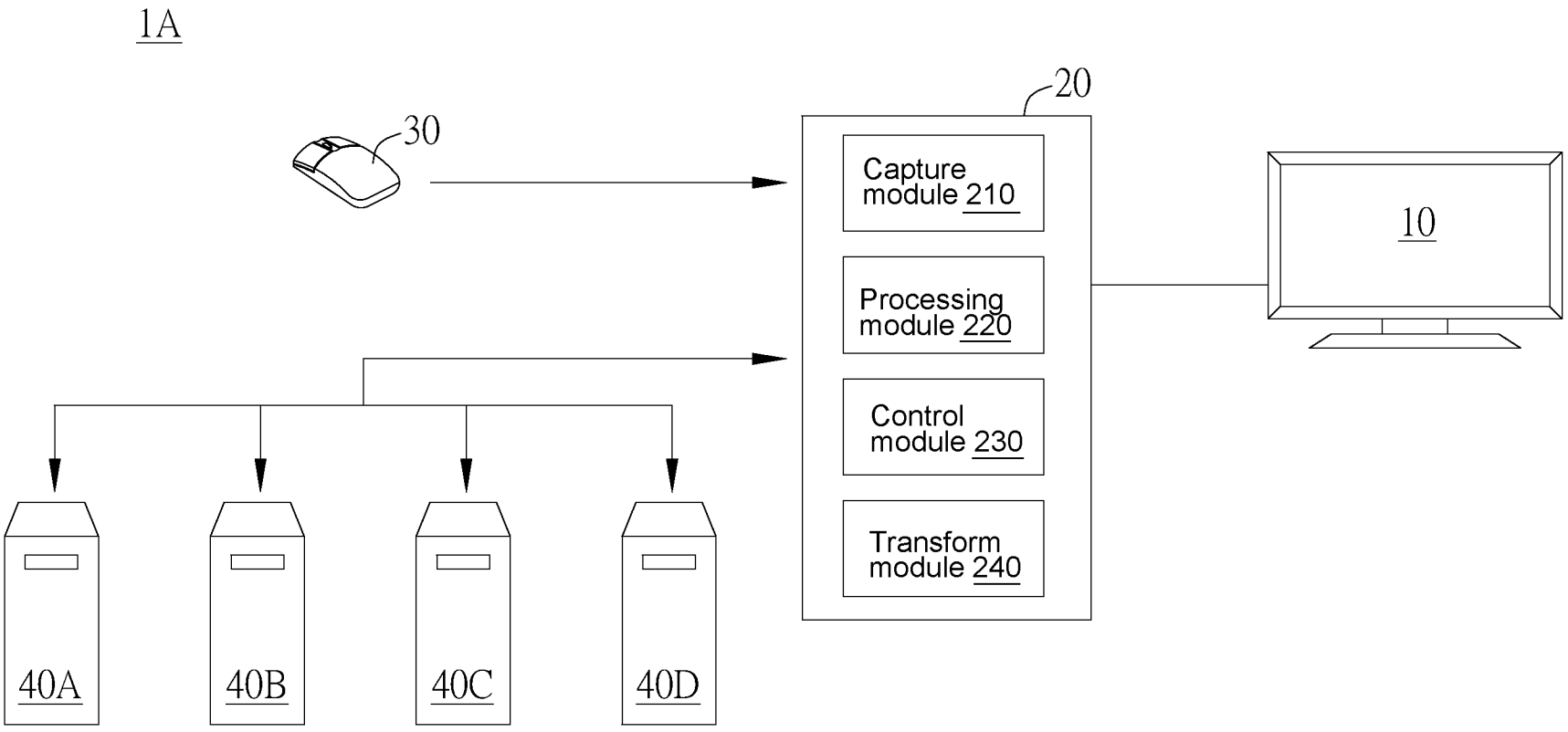
FIG. 2 schematically illustrates a multi-view system that displays multi-view images on the screen, according to another embodiment of the present invention.

FIG. 2 schematically illustrates a multi-view system 1A that displays multi-view images on the screen. The multi-view display system 1A shown in FIG. 2 may be used in the multi-view display system 1 of FIG. 1. As shown in FIG. 2, the multi-view controller 20 includes a capture module 210, processing module 220, control module 230, and transform module 240. Each of these modules may be implemented by hardware such as logic circuitry, or a processor that executes host computer-readable program code stored in associated non-volatile memory, or both. The capture module 210 captures video data from the multiple host computers 40A, 40B, 40C, 40D, and the video data is used by the processing module 220 to generate output video images on the display device 10. The control module 230 receives position data from the pointing device 30, and the position data is used by the processing module 220 to display the cursor in the output video images. Based on the position data, the processing module 220 obtains the initial position in the output video image that corresponds to the position data. The multi-view controller 20 determines the relationship between the initial position and the image of each of the multiple host computers 40A, 40B, 40C, 40D based on their depths, and based on the determination, the transform module 240 generates the absolute position of the cursor and transmits it to the corresponding host computer. Thus, by converting the position data of the pointing device 30 to the absolute coordinate to obtain the absolute position, the multi-view controller 20 can more accurately determine the position of the pointing device 30.

Figure 3:
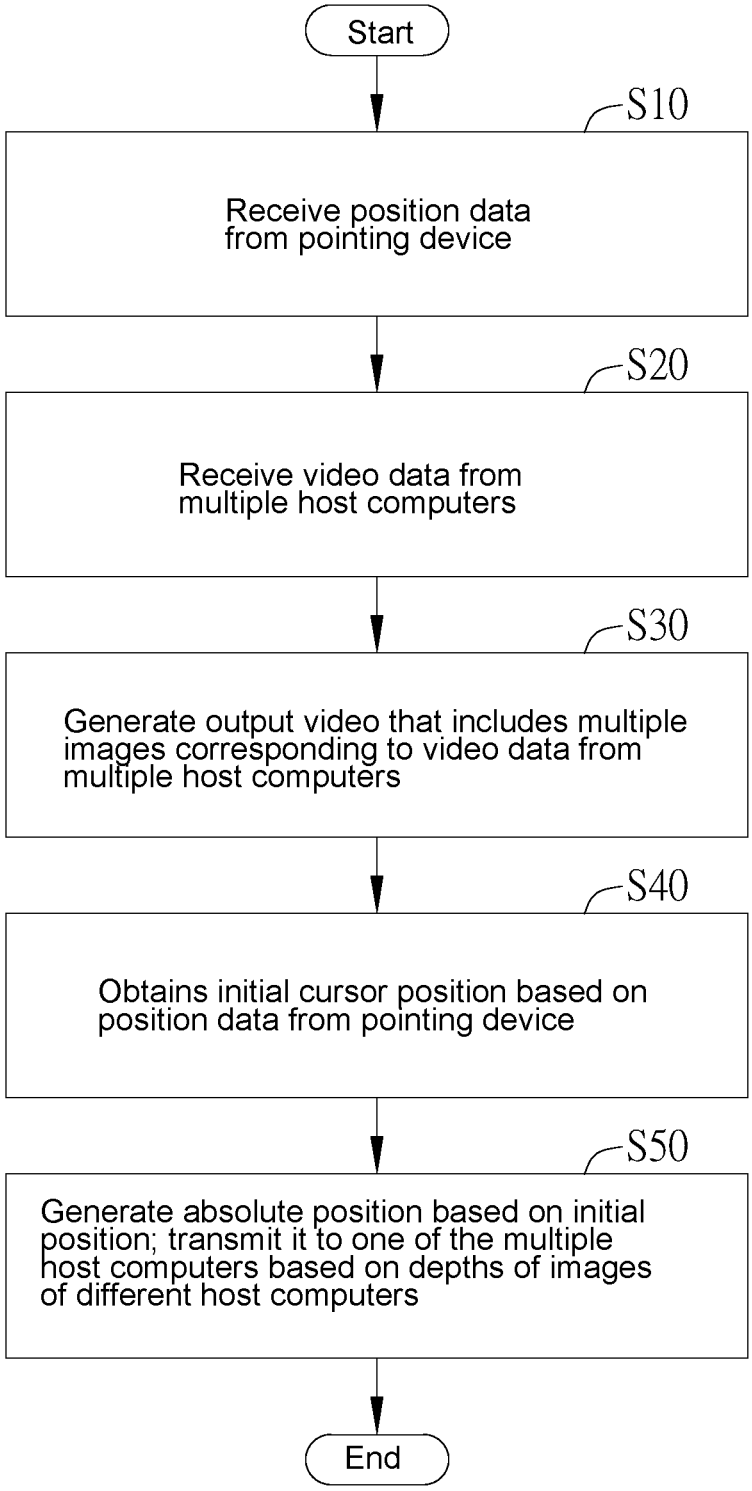
FIG. 3 schematically illustrates an operation method of a multi-view system according to an embodiment of the present invention.

FIG. 3 schematically illustrates an operation method of the multi-view system. As shown in FIG. 3, the operation method of the multi-view system includes steps S10 to S50. In step S10, the multi-view controller 20 receives position data from the pointing device. In step S20, the multi-view controller 20 respectively receives video data from the multiple different host computers. In step S30, the multi-view controller 20 generates an output video that includes multiple images corresponding to the video data from the multiple host computers, to be displayed on the display device. In step S40, the multi-view controller obtains the initial position based on the position data from the pointing device. In step S50, based on the initial position and the depths of the images of different host computers, the multi-view controller generates an absolute position and transmits it to an appropriate one of the multiple host computers 40A, 40B, 40C, and 40D.

Figure 4A:
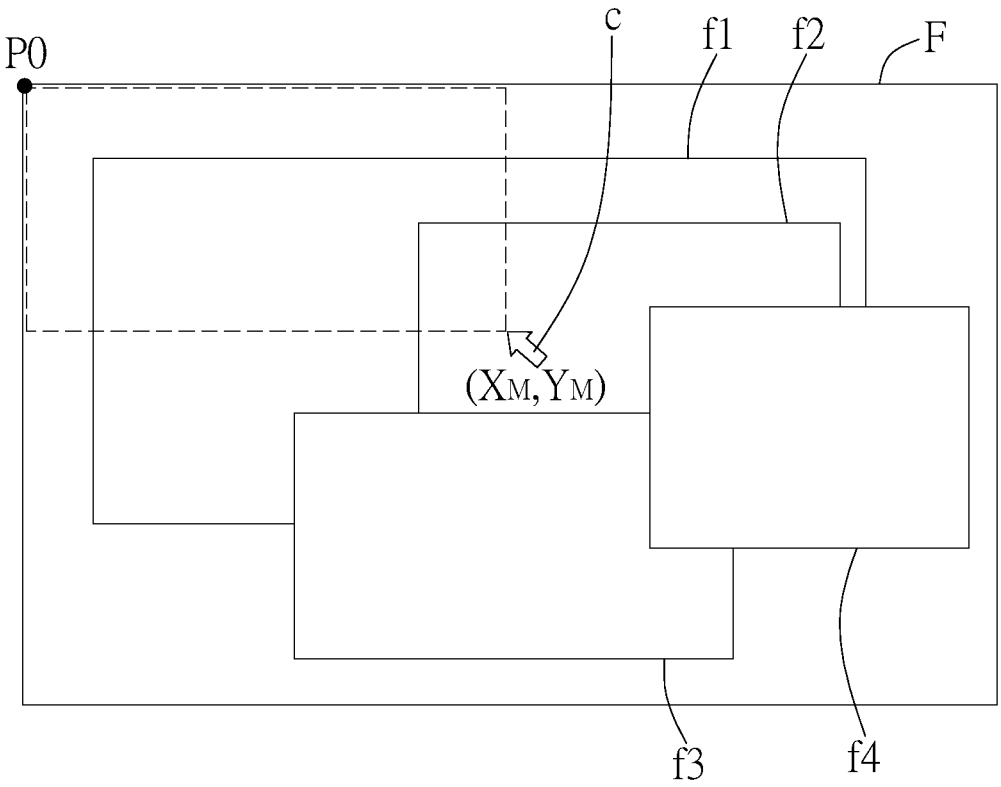
FIGS. 4A and 4B schematically illustrate an example of the displayed images according to an embodiment of the present invention.
Figure 4B:
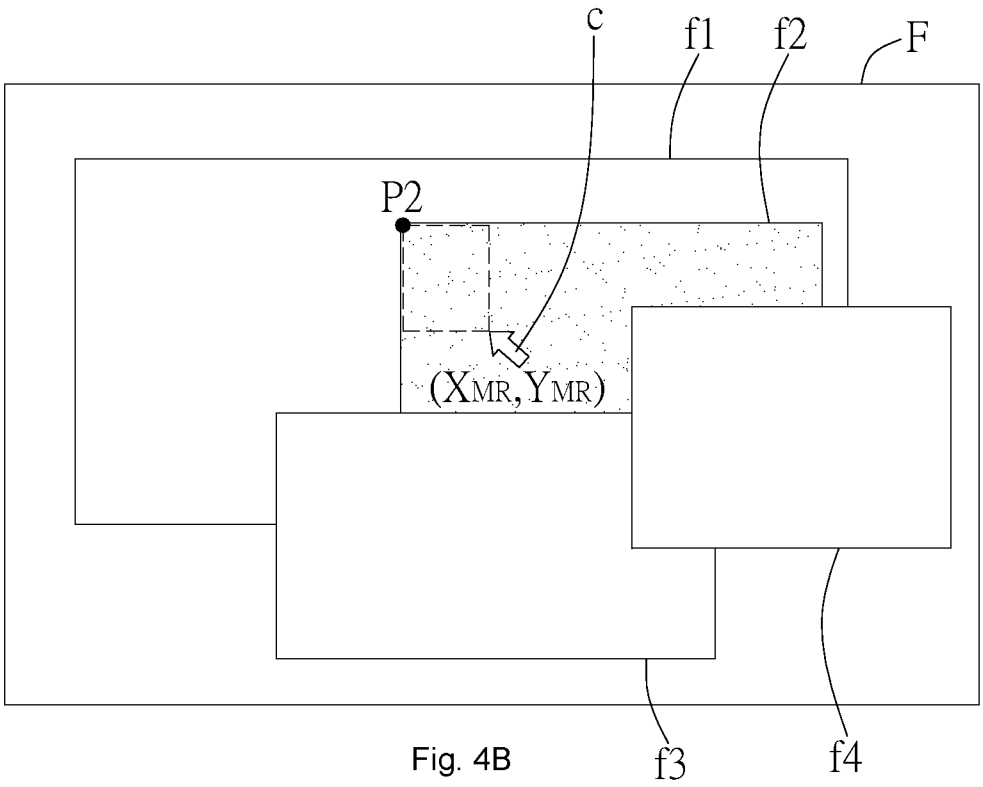

FIGS. 4A and 4B schematically illustrate an example of an output video images F. The multiple host computers respectively outputs video data, which is used by the multi-view controller to generate the video image F for display on the display device. As shown in FIG. 4A, the output video image F includes multiple images (f1, f2, f3, f4) generated based on the corresponding video data from the different host computers. For example, image f1 corresponds to host computer 40A (refer to FIG. 1), image f2 corresponds to host computer 40B, image f3 corresponds to host computer 40C, and image f4 corresponds to host computer 40D. The images corresponding to different host computers may have different depths. In this example, the positions of the images (f1, f2, f3, f4) are respectively defined by their upper-left corner, e.g., the upper-left corner of image f1 has coordinates P1($X_1$, $Y_1$, $Z_1$), the upper-left corner of image f2 has coordinates P2($X_2$, $Y_2$, $Z_2$), etc. The values $Z_1$, $Z_2$ etc. are the depths of the images f1, f2, etc. In the example shown in FIG. 4A, image f1 is located at a relatively low position with a relatively large depth. In other words, image f1 and image f2 have the relationship $Z_1>Z_2$. The depths are used to determine the order of the images to be detected, and the image with the smallest depth is the first to be detected. In the examples of FIGS. 4A and 4B, the image first to be detected is image f2.

Similarly, the position of the overall output image (i.e. output video image F) may also be defined by its upper-left corner. For example, the upper-left corner of the output image F has position P0($X_0$, $Y_0$, $Z_0$). Further, the multi-view controller receives position data from the pointing device, calculates the initial position based on the position data, and displays the cursor c in the output image. The initial position is the absolute coordinate of the cursor c in the output image F. For example, based on the position data and the value of P0, the initial position is determined to be ($X_M$, $Y_M$).

As shown in FIG. 4B, the depths are used to determine the relationship between the initial position and the images (f1, f2, f3, f4) of the different host computers, so as to obtain the coordinate (absolution position) of the cursor c in a particular one of the images. In the example of FIG. 4B, the cursor c is located in an area where image f1 and image f2 ; based on the depths of the various images, it can be determined that the cursor c is interacting with image f2. Therefore, based on the initial position and the position P2, the absolute position ($X_{MR}$, $Y_{MR}$) is obtained. This way, the absolute position obtained by transforming the absolute coordinate is dependent upon which image the cursor c is interacting with, so that the multi-view controller can more accurately determine the position of the pointing device.

Figure 5:
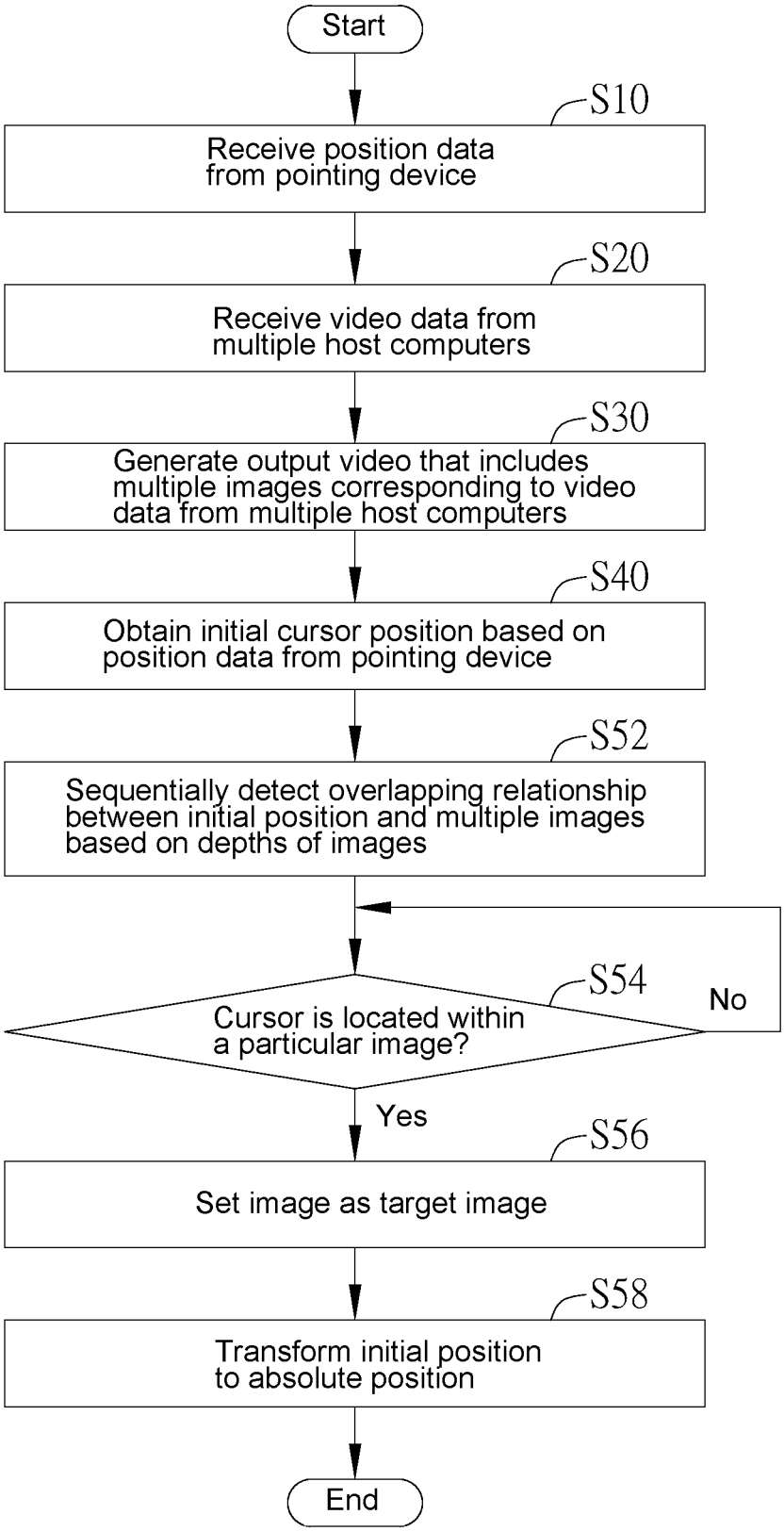
FIG. 5 is a flowchart that illustrates an operation method of a multi-view system according to another embodiment of the present invention.

FIG. 5 is a flowchart that illustrates another operation method of a multi-view system. As shown in FIG. 5, the operation method of the multi-view system includes steps S10 to S58. Steps S10 to S40 are the same as described earlier, and only the additional steps are described below. In step S52, the overlapping relationship between the initial position and the images are sequentially detected based on the depths of the images. In step S54, it is determined whether the cursor is located within the image of a particular host computer (i.e. they overlap). When it is determined in step S54 that the cursor is located within the image of the particular host computer, that image is set as the target image (step S56). On the other hand, when it is determined in step S54 that the cursor is not located within the image of the particular host computer, the process continues to determine the relationship between the cursor and the image of another host computer. In step S58, the initial position is transformed to the absolute position based on the target image.

Figure 6:
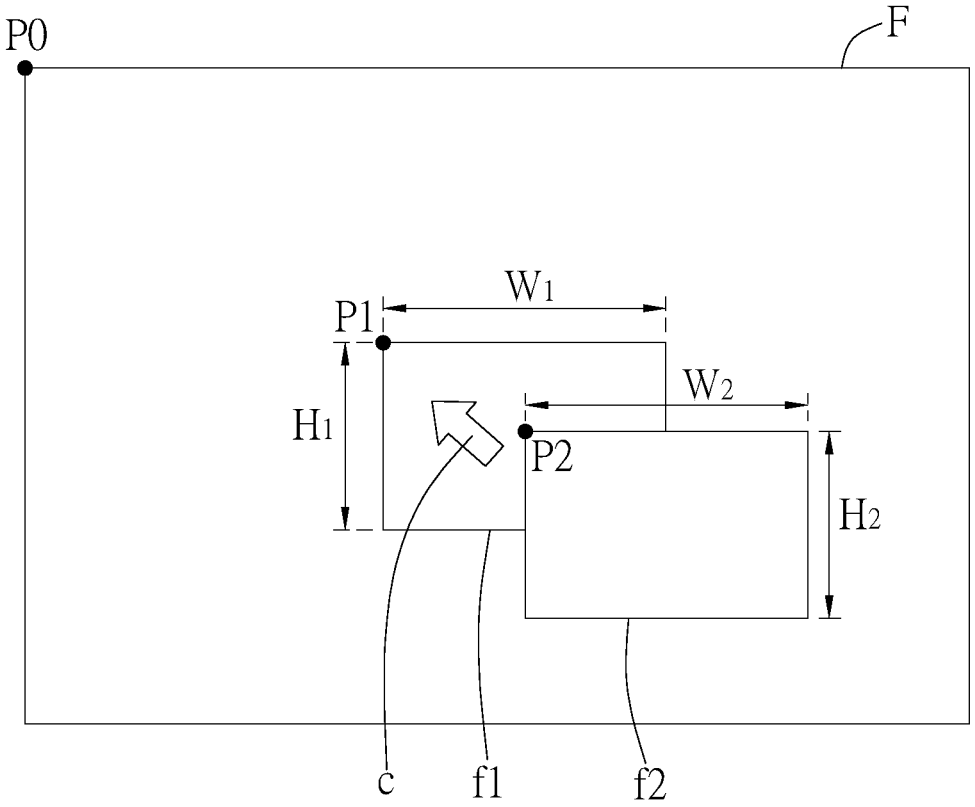
FIG. 6 schematically illustrates an example of the displayed images according to another embodiment of the present invention.

FIG. 6 schematically illustrates another example of the output video image F. The multiple host computers respectively outputs video data to be used by the multi-view controller to generate the output video image F for display on the display device. As shown in FIG. 6, the output video image F includes multiple images (f1, f2) generated based on the corresponding video data from the different host computers. For example, image f1 originates from host computer 40A (refer to FIG. 1), and image f2 originates from to host computer 40B. The image f2 partially overlays above image f1. The images (f1, f2) of the different host computers may have different widths, heights, and depths. In this example, the positions of the images are respectively defined by their upper-left corners, e.g., the upper-left corner of image f1 has coordinates P1($W_1$, $H_1$, $X_1$, $Y_1$, $Z_1$), and the upper-left corner of image f2 has coordinates P2($W_2$, $H_2$, $X_2$, $Y_2$, $Z_2$). $W_1$ and $W_2$ are respectively the widths of images f1 and f2. $H_1$ and $H_2$ are respectively the heights of images f1 and f2. $Z_1$ and $Z_2$ are respectively the depths of images f1 and f2.

The width and height may jointly define the image area of each image. For example, image f1 has an image area having a width $W_1$ and a height $H_1$, and image f2 has another image area having a width $W_2$ and a height $H_2$. Further, for each image, based on the horizontal position of the upper-left corner (e.g. $X_1$), the vertical position of the upper-left corner (e.g. $Y_1$), the width (e.g. $W_1$) and the height (e.g. $H_1$), the position and size of the image area may be defined. Meanwhile, the depths are used to determine the order of the images to be detected. For example, the image with the smallest depth is the first to be detected. In the example of FIG. 6, the image f2 is first examined to detect whether it overlaps with the initial position, and then the image f1 is examined to detect whether it overlaps with the initial position.

As shown in FIG. 6, it is determined that the cursor c is not within the image f2, so the next image to be examined is image f1, i.e. f1 is now the target image. It should be noted that when the multi-view controller detects that the initial position overlaps with a particular target image, the multi-view controller will stop further detection operation, and will next perform the position transforming step. In the example shown in FIG. 6, the cursor c is interacting with image f1, so the multi-view controller obtains the absolute position based on the initial position and P1. This way, the absolute position obtained by transforming the absolute coordinate is dependent upon which image the cursor c is interacting with, so that the multi-view controller can more accurately determine the position of the pointing device.

Figure 7A:
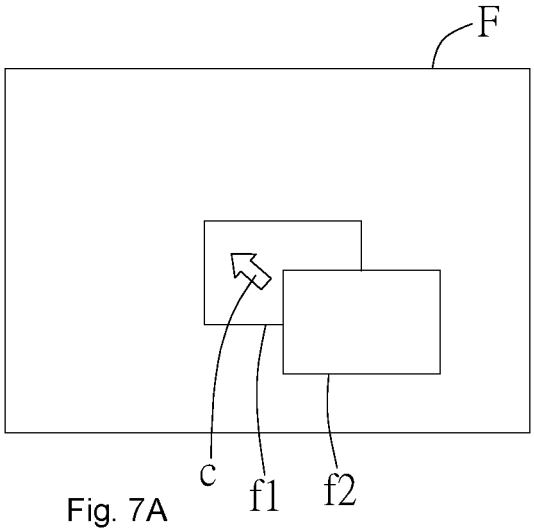
FIGS. 7A and 7B schematically illustrate an example of changing the arrangement of the displayed images according to an embodiment of the present invention.
Figure 7B:
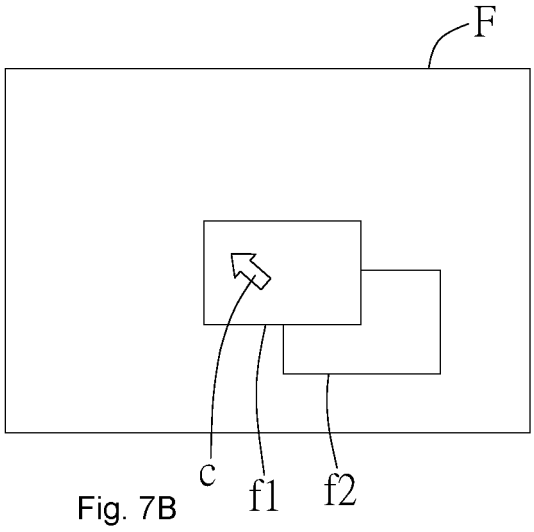

FIGS. 7A and 7B schematically illustrate an example of changing the arrangement of the displayed images. The method described earlier may further include re-arranging the images of the different host computers based on the absolute position. As shown in FIG. 7A, the cursor c is interacting with image f1, and the multi-view controller transforms the initial position to the absolute position based on the target image (image f1). As shown in FIG. 7B, the multi-view controller changes the arrangement of image f1 and image f2 based on the absolution position, to make the image that the cursor is interacting with (image f1) the top layer. This way, the absolute position is used to achieve the switching of the images, without requiring additional hardware buttons, thereby improving the convenience of the operation.

The multi-view display system 1 may be a multi-computer control system, which includes the display device 10, pointing device 30, first host computer 40A, second host computer 40B, and multi-view controller 20. It should be noted that the first host computer 40A and second host computer 40B are only examples, and the number of host computers of the multi-computer control system is not limited to the illustrated examples. The system may have four host computers (computers 40A, 40B, 40C, 40D), or other number of host computers.

The multi-view controller 20 may be a switching device, where the capture module 210 has a first and a second connection interface. The first and second connection interfaces are configured to coupled to multiple host computers (such as host computers 40A, 40B, 40C, 40D), to receive first and second video data. The processing module 220 includes a third connection interface and a processor. The third connection interface is configured to couple to the display device 10 to output video image data (e.g. F). The processor is electrically coupled to the first connection interface, the second connection interface and the third connection interface, and is configured to generate video data F based on multiple video data. The image corresponding to the output video data F includes a first sub-image (e.g. f1) and a second sub-image (e.g. f2). The first sub-image f1 corresponds to the first video data, and the second sub-image f2 corresponds to the second video data. Based on the overlapping relationship of the first sub-image f1 and the second sub-image f2, the processor determines the image to be displayed in an overlapping area of the first sub-image f1 and the second sub-image f2. It should be noted that the first and second connection interfaces here are only examples; the number of connection interfaces is not limited to two. Similarly, the first and second input video data and the corresponding first and second sub-images are also only examples, and the numbers of these components are not limited to two. Further, the first video data includes a first resolution data, and the second video data includes a second resolution data. Based on the first resolution data and the second resolution data, the processing unit computes the relative sizes of the first sub-image f1 and second sub-image f2 of the integrated image. The control module 230 is coupled to the processor of the processing module 220. When the cursor c position generated by the control module 230 is located in an area of the first sub-image f1 that does not overlap with the second sub-image f2, the processor outputs the control command from the control module 230 to the first connection interface. When the cursor c position is located in an area of the second sub-image f2 that does not overlap with the first sub-image f1, the processor outputs the control command from the control module 230 to the second connection interface. Further, when the cursor c position is located in an area where the first sub-image f1 and the second sub-image f2 overlap each other, the processor determines whether to output the control command from the control module 230 to the first connection interface or the second connection interface based on the first depth ($Z_1$) corresponding to the first video data and the second depth ($Z_2$) corresponding to the second video data.

The output video data F includes the following data: border data of the first sub-image, size data of the first sub-image (e.g. $W_1$, $H_1$), border data of the second sub-image, and size data of the second sub-image (e.g. $W_2$, $H_2$). The border data of the first sub-image defines the border positions of the first sub-image f1 within the image of the output video data F. The size data of the first sub-image ($W_1$, $H_1$) defines the size of the first sub-image f1 in the image of the output video data F. The border data of the second sub-image defines the border positions of the second sub-image f2 within the image of the output video data F. The size data of the second sub-image ($W_2$, $H_2$) defines the size of the second sub-image f2 in the image of the output video data F.

Figure 8:
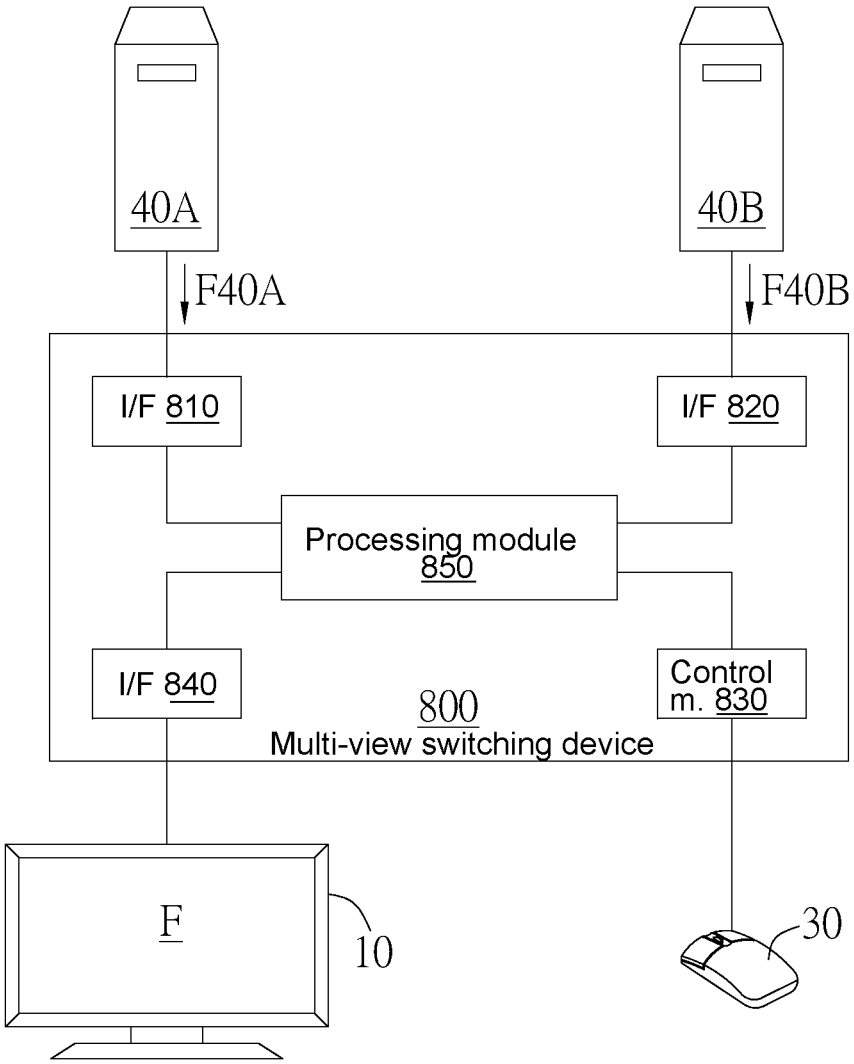
FIG. 8 schematically illustrates a switching device according to another embodiment of the present invention.

FIG. 8 schematically illustrates the multi-view controller 20 as a switching device according to another embodiment of the present invention. Referring to FIG. 8, the multi-view switching device 800 includes first connection interface 810, second connection interface 20, video output interface 840, control module 830, and processing module 850. Each of these modules may be implemented by hardware such as logic circuitry, or a processor that executes host computer-readable program code stored in associated non-volatile memory, or both. The first connection interface 810 is connected to a first host computer 40A. The second connection interface 820 is connected to a first host computer 40B. The host computers may be, for example and without limitation, personal host computers, tablet host computers, notebook host computers, etc. The first connection interface 810 receives a first video F40A from the first host computer 40A. The second connection interface 820 receives a second video F40B from the second host computer 40B. The first video F40A and the second video F40B may be, without limitation, video of the desktop of the corresponding host computers 40A, 40B or of applications being executed on the host computers. The video output interface 840 may be connected to a display screen, projector, or other display devices, and configured to output the integrated video F to the display device 10.

Regarding the first video F40A, the second video F40B and the integrated video F, these terms may be used to refer to video images that are displayed on the display device, or video data such as video image data and parameters that are transmitted by the communication interfaces and supplied to the display device to be displayed, such as, without limitation, VGA data.

While the illustrated embodiment has two host computers connected to the multi-view switching device 800, the multi-view switching device 800 may have more connection interfaces to connect to host computers, such as three connection interfaces to connect to three host computers, etc., without limitation.

The control module 830 may be coupled to a pointing device 30 such as, without limitation, mouse, track ball, touch pad, gesture recognition input device, etc. The control module 830 receives control signals from the pointing device 30, the control signals including clicking, dragging, etc. The control signals include position information, which may be generated based on the physical position and/or movement of the pointing device 30, position and/or movement of the user's hand in the case of gesture recognition based input devices, etc., without limitation.

The processing module 850 may be implemented by, without limitation, microcontroller unit (MCU), field programmable gate array (FPGA), central processing unit (CPU), etc. The processing module 850 is electrically coupled to the first connection interface 810, the second connection interface 820, the image output interface 840 and the control module 830. The processing module 850 generates an integrated video F based on the first video F40A and second video F40B.

It should be noted that the while illustrated embodiment has two host computers, this is only an example; when needed, three host computers may be used to provide the video data, which may be accomplished by providing three connection interface. The processing module 850 correspondingly generates an integrated video F based on the video data provided by the three host computers, etc.

Figure 9:
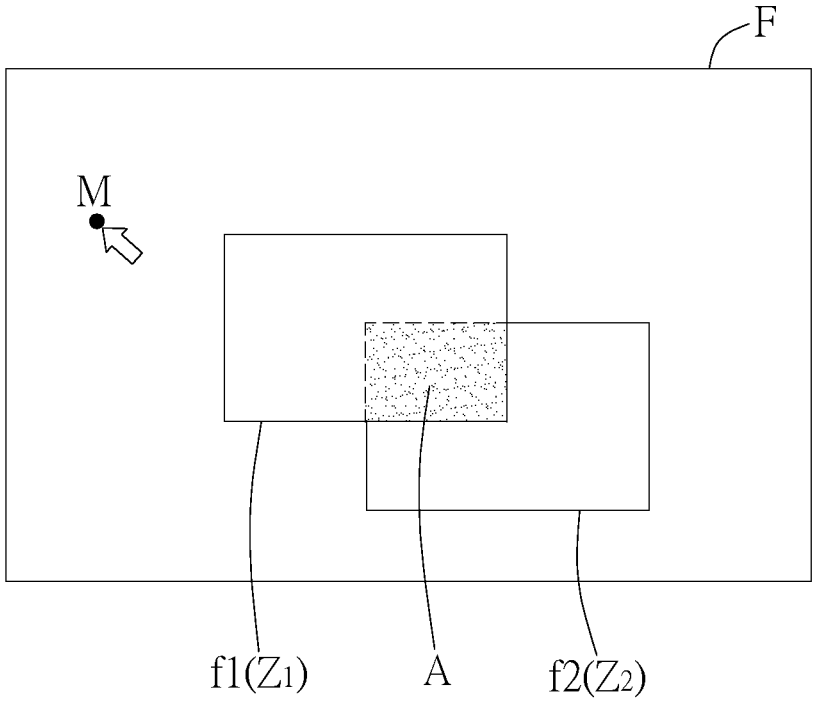
FIG. 9 schematically illustrates an example of the displayed images according to another embodiment of the present invention.

The image combination processing is described in more detail with reference to FIGS. 8 and 9. The processing module 850 respectively assigns parameters to the received first video F40A and second video F40B, such as the depth, size, and position of each image. The processing module 850 integrates the first video F40A and second video F40B based on these parameters to generate the integrated video F. The integrated video F includes a first sub-image f1 corresponding to the content of the first video F40A and a second sub-image f1 corresponding to the content of the second video F40B. The first sub-image f1 has a depth $Z_1$, and the second sub-image f2 has a depth $Z_2$. The size and position of the first sub-image f1 within the integrated video F depend on the size and position parameters that have been assigned to the first video F40A by the processing module 850. The size and position of the second sub-image f2 within the integrated video F depend on the size and position parameters that have been assigned to the second video F40A by the processing module 850.

In one embodiment, when the first sub-image f1 and the second sub-image f2 overlap in an area A, whether the overlapping area A will display the content of the first sub-image f1 or the content of the second sub-image f2 is determined by the relative order of the first depth $Z_1$ and the second depth $Z_2$. In other words, the first depth $Z_1$ and the second depth $Z_2$ have different priorities. For example, when there is an overlapping area A, if the first depth $Z_1$ has a higher priority than the second depth $Z_2$ (i.e. $Z_1$ is shallower than $Z_2$), then in the integrated video F on the display device 10, the overlapping area A of the first sub-image f1 and the second sub-image f2 will display the content of the first sub-image f1 corresponding to the overlapping area A, while the content of the second sub-image f2 corresponding to the overlapping area A will be obscured (not displayed) by the content of the first sub-image f1. In other words, the order of display of first sub-image f1 and the second sub-image f2 in the overlapping area of the integrated video F will depend on the priority order of the first depth $Z_1$ and the second depth $Z_2$. In this embodiment, when the position data M falls with the overlapping area A, the control data is output to the host computer corresponding to the sub-image whose content is displayed (not obscured) in the overlapping area.

When there are three or more sub-images, the processing module 850 assigns respective depths to the corresponding images, e.g., by assigning the first depth $Z_1$ to the first sub-image f1, assigning the second depth $Z_2$ to the second sub-image f2, and assigning the their depth to the third sub-image (not shown in the drawing). The three sub-images are integrated based on the priority order of the respective first to third depths. The sub-image with the highest priority will be displayed at the top level of the integrated video F, and the sub-image with the lowest priority will be displayed at the bottom level of the integrated video F.

In one embodiment, the first depth $Z_1$ is contained in the pixel data of each pixel of the first sub-image f1, and the second depth $Z_2$ is contained in the pixel data of each pixel of the second sub-image f2. More specifically, the depths $Z_1$ and $Z_2$ may be contained in the video data of the transmitted video, for example, contained in the parameters of the video. Take the first video F40A as an example, the first video F40A is transmitted as data, and the first sub-image f1 corresponding to the first video F40A may include multiple pixels. For example, the resolution of the first sub-image f1 may be 500 ppi (pixels per inch), meaning that it has 500 pixels per inch, but the number of pixels and their distribution are not limited to such.

Figure 10:
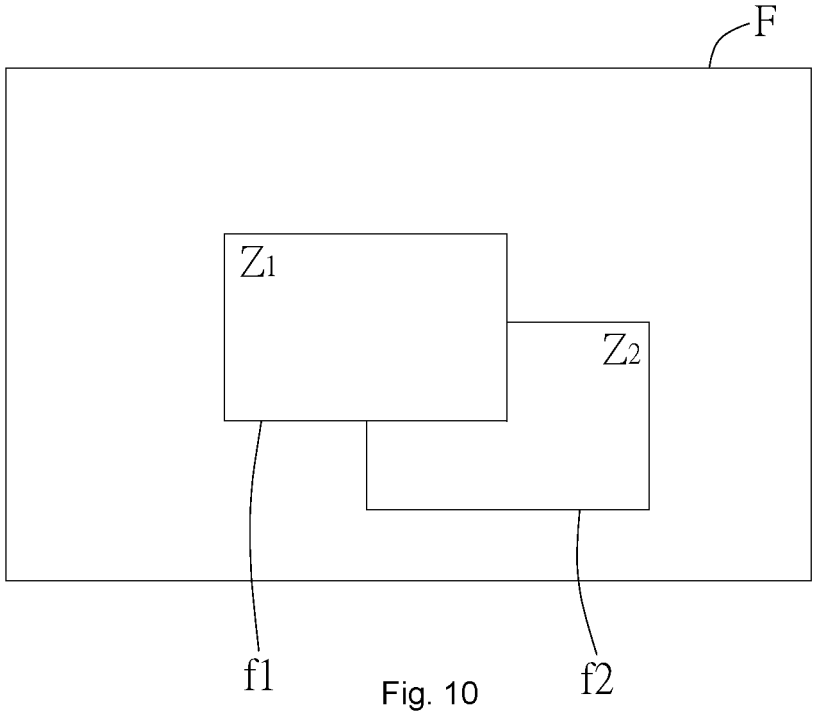
FIG. 10 schematically illustrates an example where the displayed images displays depth information according to another embodiment of the present invention.

In another embodiment, as shown in FIG. 10, the first depth $Z_1$ and the second depth $Z_2$ may be directly displayed in the integrated video F on the display device 10. For example, the first depth $Z_1$ may be directly displayed in the image content of the first sub-image f1, and the second depth $Z_2$ may be directly displayed in the image content of the second sub-image f2. Such display may be in the form of graphics or text, without limitation.

Figure 11:
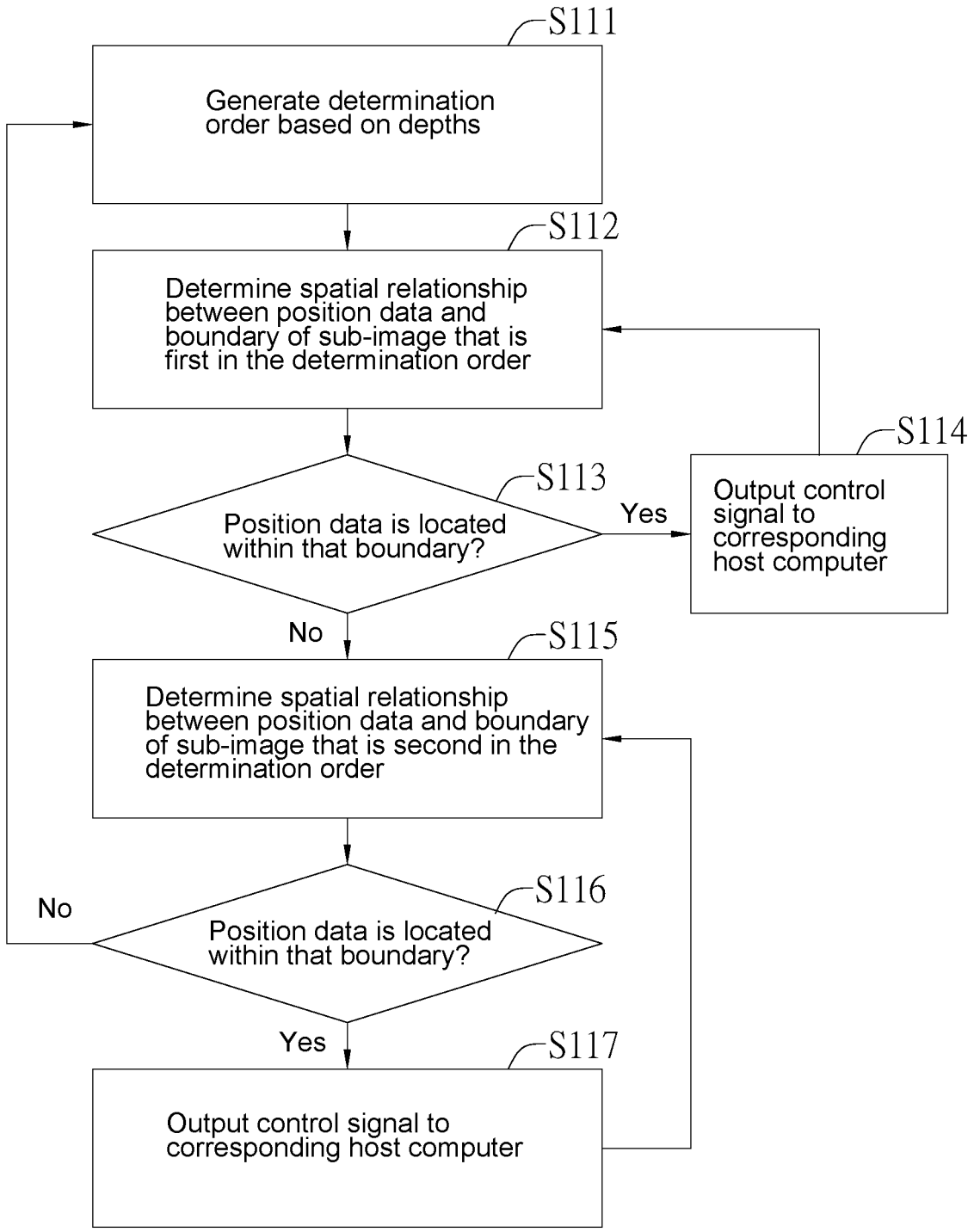
FIG. 11 is a flowchart that illustrates a method of determining pointing device positions according to another embodiment of the present invention.

In one embodiment, the processing module 850 generates a determination order based on the respective depth, and based on the determination order, sequentially determines whether the position data falls in the respective sub-images. When the position data M is determined to fall within a sub-image having a relatively high priority in the determination order, the processing module 850 can stop further determination and output the control signal to the connection interface corresponding to that sub-image. FIG. 11 is a flowchart that illustrates a method of outputting the control signal of the pointing device. Refer to FIGS. 11, 8 and 9. Step S111 includes the processing module 850 generating a determination order based on the depths $Z_1$ and $Z_2$. Step S112 includes determining the spatial relationship between the position data M and the boundary of the sub-image that is first in the determination order. In step S113, if the position data M is located within the boundary of the sub-image that is first in the determination order, then step S114 is performed to output the control signal to the host computer corresponding to that sub-image. If in step S113 the position data M is not located within the boundary of the sub-image that is first in the determination order, then step S115 is performed to continue to determine the spatial relationship between the position data M and the boundary of the sub-image that is second in the determination order. In step S116, if the position data M is located within the boundary of the sub-image that is second in the determination order, then step S117 is performed to output the control signal to the host computer corresponding to that sub-image. If in step S116 the position data M is not located within the boundary of the sub-image that is second in the determination order, then the process returns to step S111 to re-evaluate the determination order, and thereafter, to determine whether the position data M is located within the sub-image that is first in the determination order. It should be noted that the determination order, which is based on the priority order of the first depth $Z_1$ and second depth $Z_2$, may change depending on the actual status of the system. For example, when the control signal is output to a particular host computer, then the depth of that host computer will have a higher priority than the depth of the other host computers. The way that the priority order of the depths can of change is not limited to the above example. Further, the priority order of the first depth $Z_1$ and the second depth $Z_2$ may remain unchanged; in such a situation, if the determination in step S116 is negative, then step S111 of re-evaluating the determination order may be skipped, and the process proceeds directly to step S112. It should also be noted that this embodiment uses two host computers 40A, 40B as examples, but the invention is not limited to such. For example, when there are three or more host computers, the processing module 850 will still generate a determination order based on the depths. If the position data M is located within the boundary of the sub-image corresponding to the current point in the determination order, the determination process stops and the control signal of the pointing device 30 is output to the host computer via the connection interface corresponding to that sub-image. If the position data M is not located within the boundary of the sub-image corresponding to the current point in the determination order, the processing module 850 continues to process the next point in the determination order. If the current point in the determination order is at the end of the determination order, the processing module 850 continues to process the first point in the determination order, and re-determines whether position data M falls within the boundary of the sub-image corresponding to the first point in the determination order.

Figure 12:
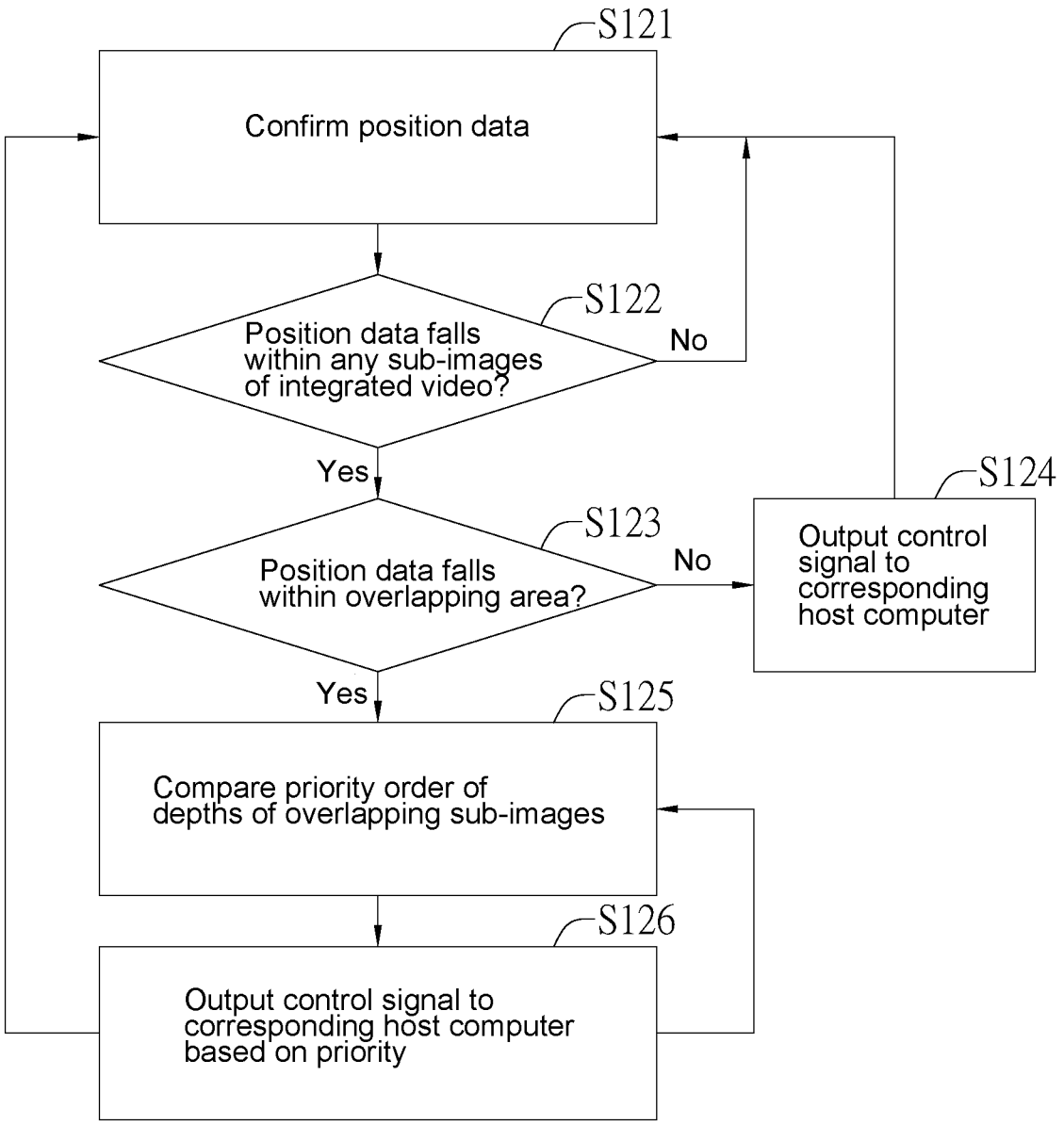
FIG. 12 is a flowchart that illustrates another method of determining pointing device positions according to another embodiment of the present invention.

Next, another embodiment of how the processing module 850 outputs the control signal of the pointing device 30 is described. In this embodiment, the processing module 850 sequentially, or according to any particular order, determines whether the position data M falls within each of the sub-images (e.g., the first sub-image f1 and the second sub-image f2). When it is determined that the position data M falls within multiple sub-images, the depths of these multiple sub-images are compared to select one of the sub-images, and the control signal is output to the host computer corresponding to the selected sub-image. Referring to FIG. 12, in step S121, the processing module 850 determines the position of the position data M. In step S122, the processing module 850 determines whether the position data M falls within any of the sub-images of the integrated video F, such as f1 and f2. If the determination in step S122 is negative, the process returns to step S121 to re-determine the position of the position data M. If the determination in step S122 is positive, then step S123 is performed, to determine whether the position data M falls within an overlapping area, such as overlapping area A. If the determination in step S123 is negative, indicating that the position data M falls within only one sub-image and does not overlap with other sub-images of the integrated video F, step S124 is performed to output the control signal to the host computer corresponding to that sub-image. For example, if the position data M of the control signal from the pointing device 30 falls within a portion of the first sub-image f1 that does not overlap with the second sub-image f2, the processing module 850 outputs the control signal via the first connection interface 810 to the first host computer 40A connected thereto, so that the first host computer 40A can be controlled by the pointing device 30. Similarly, if the position data M falls within a portion of the second sub-image f2 that does not overlap with the first sub-image f1, the processing module 850 outputs the control signal via the second connection interface 820 to the second host computer 40B connected thereto, so that the second host computer 40B can be controlled by the pointing device 30. If the determination in step S123 is positive, then step S125 is performed, where the processing module 850 compares the priority order of the depths of the sub-images that overlap in the overlapping area A. Then, in step S126, the control signal is output to the host computer that corresponds to the sub-image with the highest priority among the overlapping sub-images. For example, if the first depth $Z_1$ has a higher priority than the second depth $Z_2$, then the processing module 850 outputs the control signal via the first connection interface 810 to the first host computer 40A connected thereto, so that the first host computer 40A can be controlled by the pointing device 30.

To determine the priority order, the first depths $Z_1$ has a first sequence number and the second depths $Z_2$ has a second sequence number. The priority order is determined based on the relative order of the first sequence number and second sequence number. The relative order of the first sequence number and the second sequence number may be set by the user, by the processing module 850, or by the sequence of the connection interfaces. For example, the sequence number corresponding to the first connection interface 810 may be set to have a higher priority than the sequence number corresponding to the second connection interface 820. But the method of determining the priority order is not limited to the above examples.

Further, the priority order of the first sequence number of the first depth $Z_1$ and the second sequence number of the second depth $Z_2$ may change based on the operation situations. For example, when the processing module 850 changes the output target of the control signals, the relative priority of the first sequence number and second sequence number may be adjusted accordingly. When output target of the control signal output by the processing module 850 is switched from the first host computer 40A to the second host computer 40B, the second sequence number which had a lower priority than the first sequence number is now adjusted to have a higher priority than the first sequence number. Or, when the importance of the second video F40B transmitted by the second host computer 40B is greater than that of the first video F40A, the second sequence number may have a higher priority than the first sequence number. The situations that affect the importance of a video may include, for example, when the second host computer 40B outputs an alert by an application program or is currently executing an application program, or when the user is currently clicking on a content (e.g. an icon) of the second video F40B of the second host computer 40B. Other situations may also affect the importance. The evaluation of the importance may be performed by the processing module 850, the first host computer 40A, the second host computer 40B, or the user.

Figure 13A:
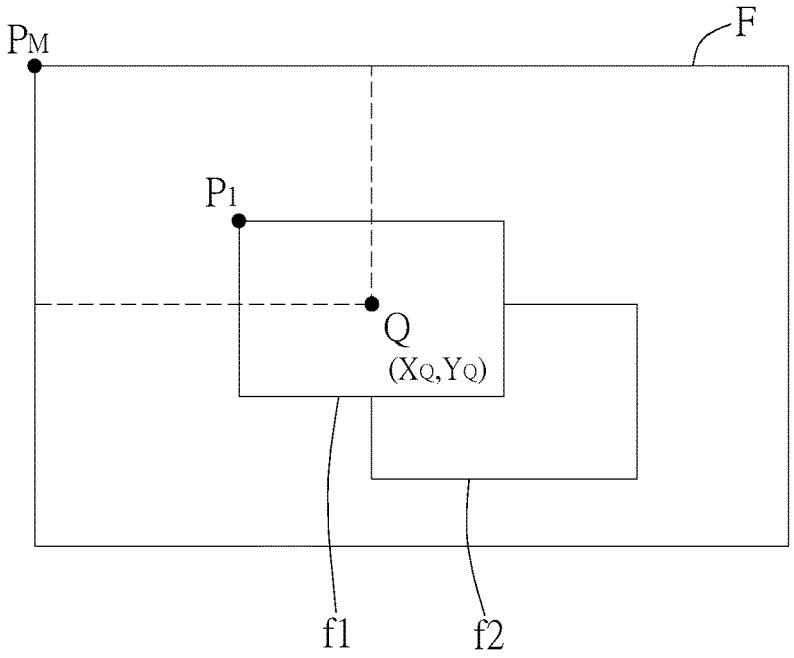
FIGS. 13A and 13B schematically illustrate a coordinate transformation of the displayed images.
Figure 13B:
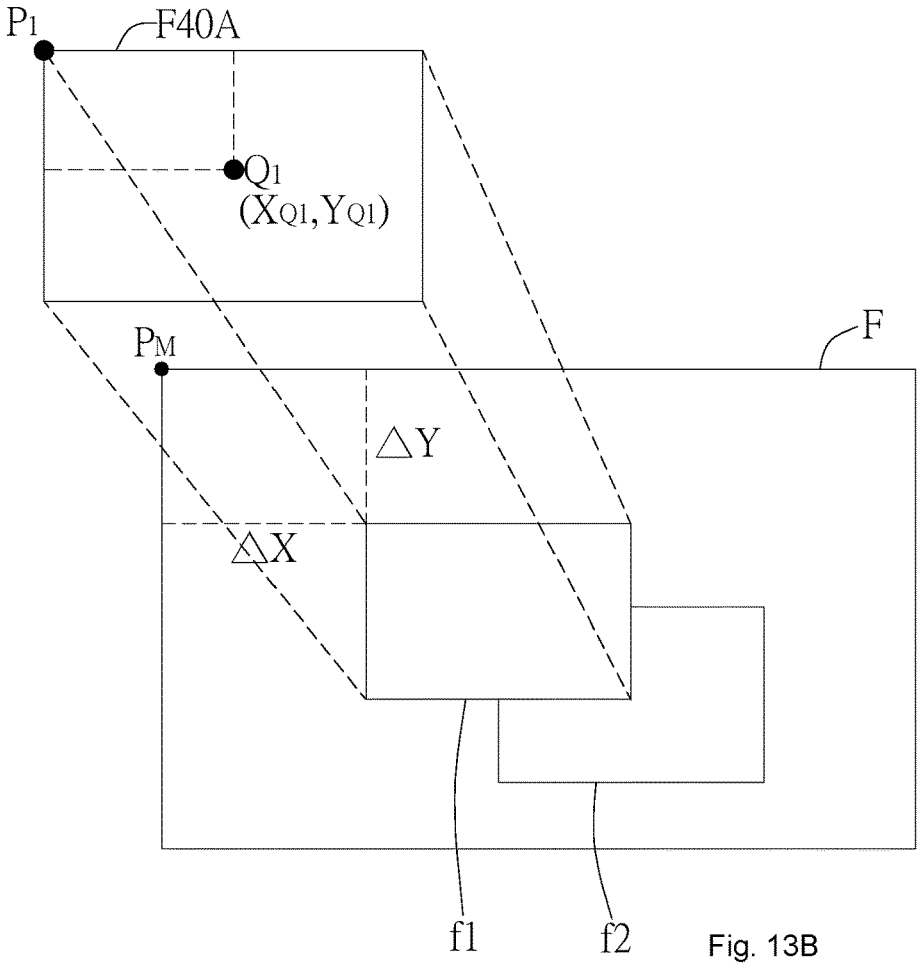

FIG. 13A schematically illustrates an example of the integrated video F. In the illustrated example, the first video F40A corresponds to a first coordinate system, the second video F40B corresponds to a second coordinate system, and the integrated video F corresponds to an integrated coordinate system. For points located within the first sub-image f1, their coordinate values in the first coordinate system may be transformed to and from their coordinate values in the integrated coordinate system using a first transformation, and for points located within the second sub-image f2, their coordinate values in the second coordinate system may be transformed to and from their coordinate values in the integrated coordinate system using a second transformation. Using the first and second transformation, respectively, the first and second video F40A and F40B can be transformed to the first and second sub-images f1 and f2, respectively. More specifically, the integrated video F may correspond to the integrated coordinate system, where the integrated coordinate system has a reference point $P_M$ located, for example, at the upper left corner of the integrated video F. A point Q of the integrated video F may be represented by integrated coordinate value ($X_Q$, $Y_Q$) in the integrated coordinate system, where $X_Q$ represents the horizontal distance between point Q and the reference point $P_M$, and $Y_Q$ represents the vertical distance between point Q and the reference point $P_M$. Referring to FIG. 13B, the first sub-image f1 that corresponds to the first video F40A has a reference point $P_1$, such as the upper-left corner of the first sub-image f1, and a point $Q_1$ (the same point as Q) in the first sub-image f1 may be represented by the first coordinate value ($X_{Q1}$, $Y_{Q1}$) in the first coordinate system, where $X_{Q1}$ represents the horizontal distance between the point $Q_1$ and the reference point $P_1$, and $Y_{Q1}$ represents the vertical distance between the point $Q_1$ and the reference point $P_1$. Reference point $P_M$ has a horizontal distance ΔX and a vertical distance ΔY from reference point $P_1$. Then, the integrated coordinate value can be transformed to the first coordinate value using equations 1.1 and 1.2, although the transformation method is not limited to such. It should be noted that the first sub-image f1 is used as an example here, but the embodiment is not limited to the first sub-image f1, and is also not limited by the number of sub-images.

$$X_Q-\Delta X=X_{Q1} \tag{1.1}$$

$$Y_Q-\Delta Y=Y_{Q2} \tag{1.2}$$

Figure 14:
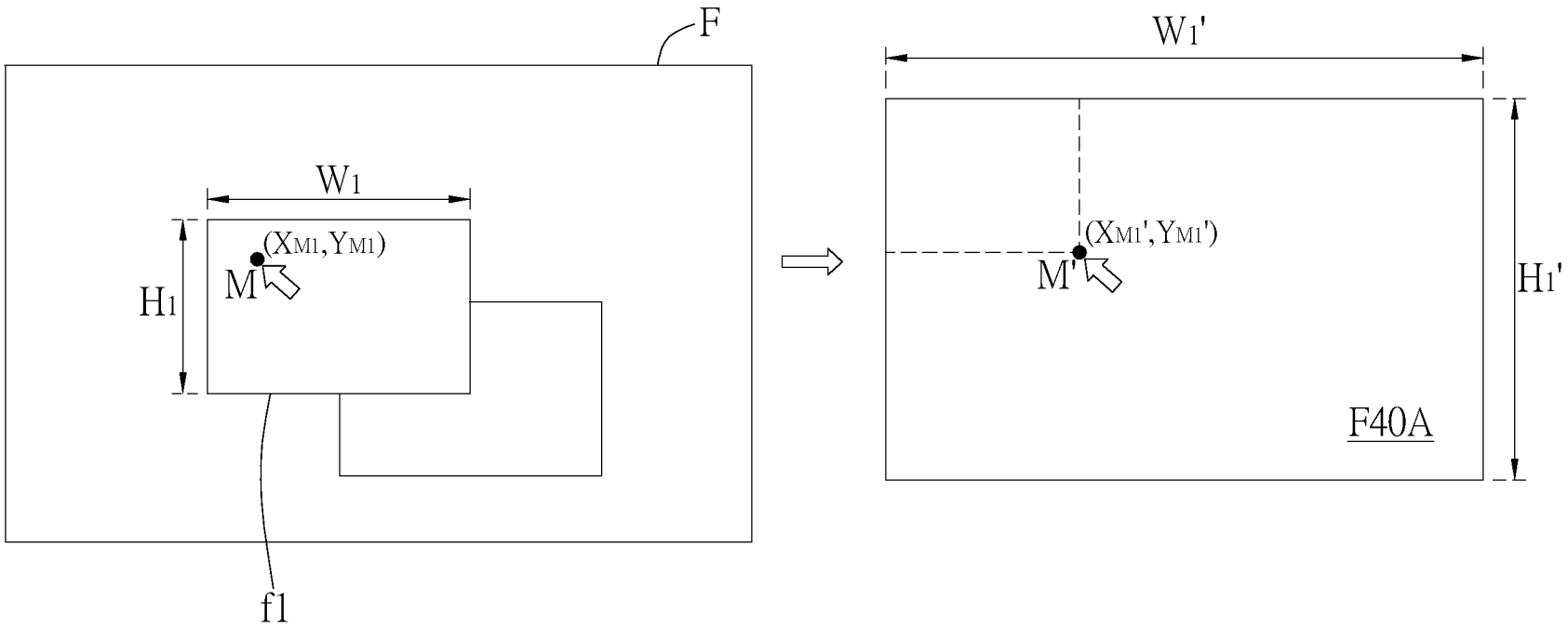
FIG. 14 schematically illustrates a coordinate transformation of the pointing device.

FIG. 14 schematically illustrates a coordinate transform when the processing module outputs the control signal to the host computer. Refer to FIG. 8 and FIG. 14, the first host computer 40A has a first video F40A. When the processing module 850 outputs the control signal via the first connection interface 810, it transforms the position data M in the integrated coordinate system to a first position data M' in the first coordinate system using the first transformation. More specifically, the position data M received from the pointing device 30 has a coordinate value ($X_M$, $Y_M$) in the integrated coordinate system. This position data M is also located within the first sub-image f1, so the coordinate value ($X_M$, $Y_M$) can be transformed to coordinate value ($X_{M1}$, $Y_{M1}$) in the first coordinate system. When the switching device 800 outputs the control signal from the pointing device 30 to the first host computer 40A via the first connection interface 810, the position data M will have a corresponding first position data M' in the first video F40A of the first host computer 40A. The coordinate value ($X_{M1}$, $Y_{M1}$) of the position data M in the first coordinate system corresponds to the coordinate value ($X_{M1}'$, $Y_{M1}'$) of the position data M' in first video F40A. This corresponding relationship is scaled based on the ratio of the resolution $W_1 \times H_1$ of the first sub-image f1 and the resolution $W_1' \times H_1'$ of the first video F40A, e.g., as in equations 2.1 and 2.2, although the relationship between the position data M and the first position data M' is not limited to such.

$$\frac{W_1}{W_1'} \times X_1 = X_1' \tag{2.1}$$

$$\frac{H_1}{H_1'} \times Y_1 = Y_1' \tag{2.2}$$

Figure 15:
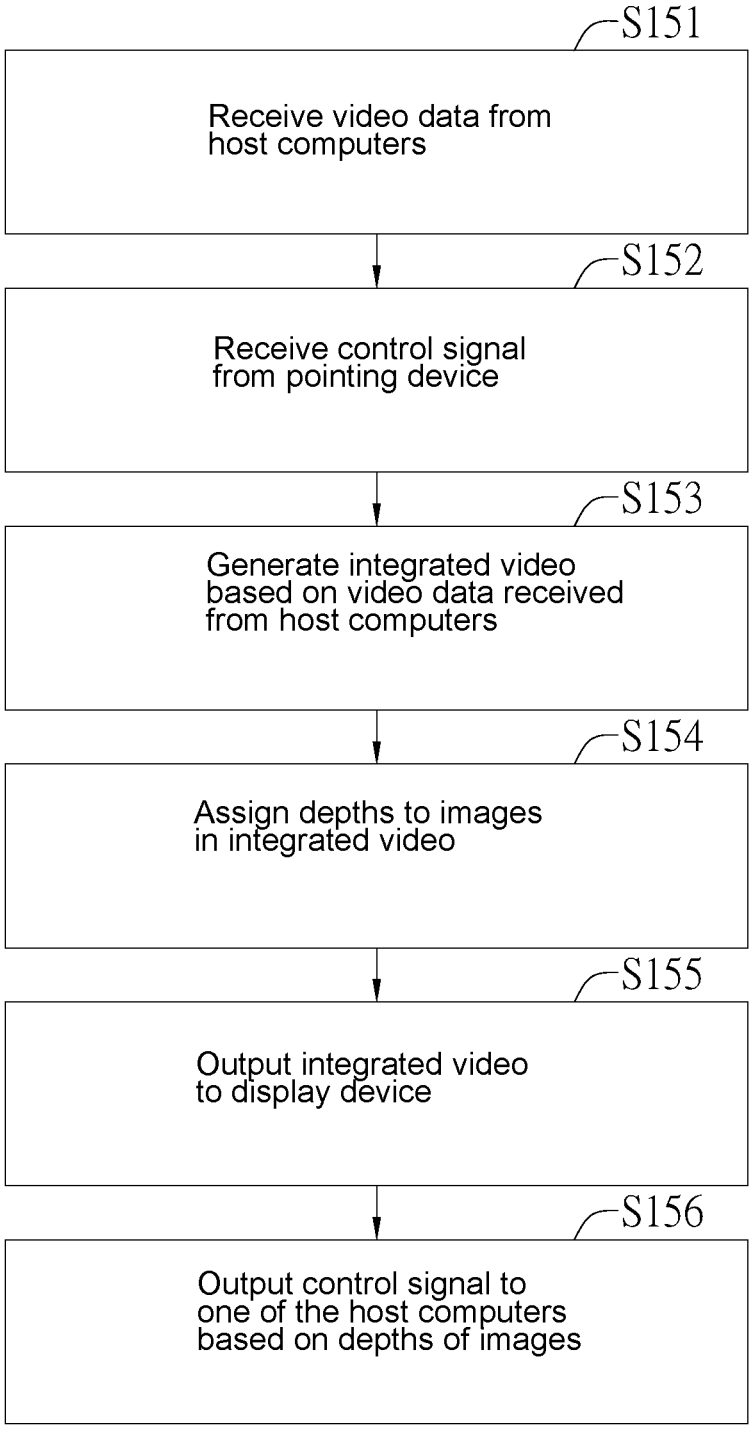
FIG. 15 is a flowchart that illustrates a switching method according to another embodiment of the present invention.

FIG. 15 is a flowchart that illustrates an operation method of the switching device 800. Referring to FIG. 15, FIG. 8 and FIG. 9, the operation method includes the following steps. Step S151 includes receiving video data. More specifically, it includes receiving the first video F40A from the first host computer 40A which is connected to the first connection interface 810, and receiving the second video F40B from the second host computer 40B which is connected to the second connection interface 820. Step S152 includes receiving the control signal. More specifically, the control module 830 receives the control signal, including the position data M, from the pointing device 30 connected to the control module 830. Step S153 includes generating the integrated video F. More specifically, the processing module 850 generates the integrated video F based on the first video F40A and the second video F40B. The integrated video F includes the first sub-image f1 corresponding to the first video F40A and the second sub-image f2 corresponding to the second video F40B. Step S154 includes the processing module 850 assigning depths to the first video F40A and the second video F40B, so that the first sub-image f1 has a first depth $Z_1$, and the second sub-image f2 has a second depth $Z_2$. Step S155 includes outputting the integrated video F to the display device. Step S156 includes outputting the control signal to the host computer. More specifically, a part of the first sub-image f1 and a part of the second sub-image f2 overlap in an overlapping area A. When the position data M falls within the overlapping area A, based on the first depth $Z_1$ and the second depth $Z_2$, one of the first connection interface 810 and the second connection interface 820 is selected, and the control signal is outputted to the selected connection interface, so that the pointing device 30 can control the corresponding host computer.

From the above descriptions, it can be seen that, when the multiple images originating from multiple host computers overlap each other on the display device, the switching device and system according to embodiments of the present invention can use the depths of the images and the coordinate transformation method to allow the user to accurately control the desired host computer using the mouse.

It will be apparent to those skilled in the art that various modification and variations can be made in the switching system and related method of the present invention without departing from the spirit or scope of the invention. Thus, it is intended that the present invention cover modifications and variations that come within the scope of the appended claims and their equivalents.

What is claimed is:

1. A switching device for multi-view switching, comprising:

a first connection interface, configured to receive a first video;

a second connection interface, configured to receive a second video;

a video output interface, configured to output an integrated video;

a control module, configured to receive a control signal, the control signal including a position data; and a processing module, electrically coupled to the first connection interface, the second connection interface, the image output interface, and the control module, wherein the processing module is configured to generate the integrated video based on the first video and the second video;

wherein the integrated video includes a first sub-image and a second sub-image, the first sub-image having a first depth, the second sub-image having a second depth, the first sub-image corresponding to the first video, and the second sub-image corresponding to the second video;

wherein when a part of the first sub-image and a part of the second sub-image overlap each other in an overlapping area, and the position data falls within the overlapping area, the processing module is configured to select one of the first connection interface and the second connection interface based on the first depth and the second depth and to output the control signal via the selected first or second connection interface.

2. The switching device of claim 1, wherein the processing module is configured to generate a determination order based on the first depth and the second depth, and based on the determination order, to sequentially determine whether the position data falls within the first sub-image or the second sub-image; and wherein when the position data falls within the first sub-image, the processing module is configured to stop further determination in the determination order, and to output the control signal to the first connection interface.

3. The switching device of claim 1, wherein the processing module is configured to respectively determine whether the position data falls within the first sub-image or the second sub-image; wherein when the position data falls simultaneously within both the first sub-image and the second sub-image, the processing module is configured to compare relative priorities of the first depth and the second depth and to output the control signal via the first connection interface or the second connection interface based on the comparison.

4. The switching device of claim 1, wherein the first video corresponds to a first coordinate system, the second video corresponds to a second coordinate system, and the integrated video corresponds to an integrated coordinate system; wherein for points located within the first sub-image, their coordinate values in the first coordinate system are transformable to and from their coordinate values in the integrated coordinate system using a first transformation, and for points located within the second sub-image, their coordinate values in the second coordinate system are transformable to and from their coordinate values in the integrated coordinate system using a second transformation.

5. The switching device of claim 4, wherein the processing module is configured to, when outputting the control signal via the first connection interface, transform the position data in the integrated coordinate system to a first position data in the first coordinate system using the first transformation.

6. The switching device of claim 1, wherein the processing module is configured to determine whether a content of the first sub-image or a content of the second sub-image is displayed in the overlapping area based on relative priorities of the first depth and the second depth; and wherein when the content of the first sub-image is displayed in the overlapping area, the processing module is configured to output the control signal to the first connection interface.

7. The switching device of claim 1, wherein the processing module is configured to assign a first size and a first position to the first video and assign a second size and a second position to the second video; and wherein the processing module is configured to determine a boundary and a position of the first sub-image based on the first size and the first position, and to determine a boundary and a position of the second sub-image based on the second size and the second position.

8. A control method for a switching device, the method comprising:

receiving a first video via a first connection interface;

receiving a second video via a second connection interface;

receiving a control signal, the control signal including a position data; and generating an integrated video based on the first video and the second video, wherein the integrated video includes a first sub-image and a second sub-image, the first sub-image having a first depth, the second sub-image having a second depth, the first sub-image corresponding to the first video, and the second sub-image corresponding to the second video;

outputting the integrated video; and when the position data falls within an overlapping area where a part of the first sub-image and a part of the second sub-image overlap each other, selecting one of the first connection interface and the second connection interface based on the first depth and the second depth, and outputting the control signal via the selected first or second connection interface.

9. The control method of claim 8, wherein the selecting step includes:

generating a determination order based on the first depth and the second depth;

based on the determination order, sequentially determining whether the position data falls within the first sub-image or the second sub-image; and when the position data falls within the first sub-image, stopping further determination in the determination order, and selecting the first connection interface for outputting the control signal.

10. The control method of claim 8, wherein the selecting step includes:

determining whether the position data falls within the first sub-image or the second sub-image; and when the position data falls simultaneously within both the first sub-image and the second sub-image, comparing relative priorities of the first depth and the second depth, and selecting the first connection interface or the second connection interface based on the comparison of the relative priorities.

11. The control method of claim 8, wherein the first video corresponds to a first coordinate system, the second video corresponds to a second coordinate system, and the integrated video corresponds to an integrated coordinate system, wherein for points located within the first sub-image, their coordinate values in the first coordinate system are transformable to and from their coordinate values in the integrated coordinate system using a first transformation, and for points located within the second sub-image, their coordinate values in the second coordinate system are transformable to and from their coordinate values in the integrated coordinate system using a second transformation, and wherein the step of generating the integrated video includes:

transforming the first video to the first sub-image using the first transformation; and transforming the second video to the second sub-image using the second transformation.

12. The control method of claim 11, wherein the received position data is defined in the integrated coordinate system, wherein the selecting step selects the first connection interface, when the step of outputting the control signal includes transforming the position data defined in the integrated coordinate system to a first position data defined in the first coordinate system using the first transformation, and wherein the step of outputting the control signal includes of outputting the control signal via the first connection interface.

13. The control method of claim 8, further comprising:

determining relative priorities of the first depth and the second depth;

displaying a content of the first sub-image or a content of the second sub-image in the overlapping area based on which depth has a higher relative priority; and when the content of the first sub-image is displayed in the overlapping area, outputting the control signal to the first connection interface.

14. The control method of claim 8, wherein the step of generating the integrated video includes:

assigning a first size and a first position to the first video;

assigning a second size and a second position to the second video;

determining a boundary and a position of the first sub-image based on the first size and the first position; and determining a boundary and a position of the second sub-image based on the second size and the second position.

15. A switching system, comprising:

a switching device;

a first host computer, coupled to the switching device, configured to provide a first video to the switching device;

a second host computer, coupled to the switching device, configured to provide a second video to the switching device, wherein the switching device is configured to generate an integrated video based on the first video and the second video;

a pointing device, coupled to the switching device, configured to provide a control signal to the switching device, the control signal including a position data; and a display device, coupled to the switching device, configured to receive the integrated video from the switching device and to display the integrated video;

wherein the integrated video includes a first sub-image and a second sub-image, the first sub-image having a first depth, the second sub-image having a second depth, the first sub-image corresponding to the first video, and the second sub-image corresponding to the second video;

wherein when a part of the first sub-image and a part of the second sub-image overlap each other in an overlapping area, and the position data falls within the overlapping area, the processing module is configured to select one of the first host computer and the second host computer based on the first depth and the second depth and to output the control signal received from the pointing device to the selected first or second host computer.

16. The switching system of claim 15, wherein the switching device is configured to generate a determination order based on the first depth and the second depth, and based on the determination order, to sequentially determine whether the position data falls within the first sub-image or the second sub-image; and wherein when the position data falls within the first sub-image, the switching device is configured to stop further determination in the determination order, and to output the control signal to the first host computer.

17. The switching system of claim 15, wherein the switching device is configured to respectively determine whether the position data falls within the first sub-image or the second sub-image; wherein when the position data falls simultaneously within both the first sub-image and the second sub-image, the switching device is configured to compare relative priorities of the first depth and the second depth and to output the control signal via the first host computer or the second host computer based on the comparison.

18. The switching system of claim 15, wherein the first video corresponds to a first coordinate system, the second video corresponds to a second coordinate system, and the integrated video corresponds to an integrated coordinate system; wherein for points located within the first sub-image, their coordinate values in the first coordinate system are transformable to and from their coordinate values in the integrated coordinate system using a first transformation, and for points located within the second sub-image, their coordinate values in the second coordinate system are transformable to and from their coordinate values in the integrated coordinate system using a second transformation.

19. The switching system of claim 18, wherein the switching device is configured to, when outputting the control signal received from the pointing device to the first host computer, transform the position data in the integrated coordinate system to a first position data in the first coordinate system using the first transformation.

20. The switching system of claim 19, wherein the switching device is configured to determine whether a content of the first sub-image or a content of the second sub-image is displayed in the overlapping area based on relative priorities of the first depth and the second depth; and wherein when the content of the first sub-image is displayed in the overlapping area, the switching device is configured to output the control signal to the first host computer.

21. The switching system of claim 15, wherein the switching device is configured to assign a first size and a first position to the first video and assign a second size and a second position to the second video; and wherein the switching device is configured to determine a boundary and a position of the first sub-image based on the first size and the first position, and to determine a boundary and a position of the second sub-image based on the second size and the second position.

* * * * *